US008803753B2

(12) United States Patent
Arranz Arauzo et al.

(10) Patent No.: US 8,803,753 B2
(45) Date of Patent: Aug. 12, 2014

(54) ANTENNA ARRANGEMENT

(75) Inventors: Miguel Arranz Arauzo, Madrid (ES); Javier Lopez Roman, Madrid (ES); Julio Urbano Ruiz, Madrid (ES); Clara Serrano Solsona, Madrid (ES); Mai Tran Le, Newbury (GB)

(73) Assignee: Vodafone IP Licensing Limited, Newbury, Berkshire (GB)

( * ) Notice: Subject to any disclaimer, the term of this patent is extended or adjusted under 35 U.S.C. 154(b) by 405 days.

(21) Appl. No.: 13/280,511

(22) Filed: Oct. 25, 2011

(65) Prior Publication Data

US 2012/0127052 A1 May 24, 2012

(30) Foreign Application Priority Data

Oct. 25, 2010 (EP) ..... 10382279

(51) Int. Cl.
*H01Q 9/30* (2006.01)

(52) U.S. Cl.
USPC ..... 343/819; 343/815

(58) Field of Classification Search
USPC ..... 343/815, 818, 819, 833, 834
See application file for complete search history.

(56) References Cited

U.S. PATENT DOCUMENTS

| | | | | |
|---|---|---|---|---|
| 4,028,709 | A * | 6/1977 | Berkowitz et al. | 343/819 |
| 4,218,686 | A * | 8/1980 | Blonder | 343/819 |
| 6,307,524 | B1 * | 10/2001 | Britain | 343/795 |
| 7,629,938 | B1 * | 12/2009 | Josypenko | 343/815 |
| 2007/0139291 | A1 | 6/2007 | Sabet et al. | |

FOREIGN PATENT DOCUMENTS

| | | |
|---|---|---|
| JP | 2000 278037 | 10/2000 |
| JP | 2006 049945 | 2/2006 |
| KR | 200 439 899 | 5/2008 |

OTHER PUBLICATIONS

Karl Rothammel: "Antennenbuch", Jan. 1, 1984, Telekosmos-Verlag Franckh'sche Verlagshandlung, Stuttgart, Germany, XP002617550, pp. 246-253.

* cited by examiner

*Primary Examiner* — Tan Ho
(74) *Attorney, Agent, or Firm* — B. Aaron Schulman, Esq.; Stites & Harbison, PLLC.

(57) ABSTRACT

The invention relates to data transmission in radio communication networks, the object of the invention multiband directional antenna comprising a multidimensional array structure and having more than one director working in active or passive mode according to the working frequency.

15 Claims, 2 Drawing Sheets

ANTENNA ARRANGEMENT

FIELD OF THE INVENTION

The invention relates to an antenna arrangement for wireless communication networks. In particular the invention, relates to a multiband antenna arrangement.

BACKGROUND

Currently Mobile Telecommunications Network Operators (MNOs) are working with more and more technologies, using different frequencies and bands. To be able to achieve the demand of these multi technologies, the Operators will need to place different antennas for different technologies, making the site enormous.

Other solution will be to use multi-band antennas which are big in length and width when compared to existing single band antennas, making the site or building unattractive for the everyday viewer and hard to install.

The ideal solution would be a multi-band antenna with small size and good directivity. There is a good candidate for a compact and high-directivity antenna: the Yagi antenna.

The Yagi (or Yagi-Uda) antenna is a linear array of parallel dipoles. One element is energised directly by a feed transmission line with the others acting as parasitic radiators.

The Yagi-Uda is built for one frequency. Reflector and Directors length and also the spacing between them is calculated depending of the Yagi work frequency.

This structure makes the Yagi a good directivity antenna.

Yagi antenna is a directional antenna system, it has one dipole connected to the transmission line and a number of equally spaced unconnected dipoles mounted parallel to the first in the same horizontal plane to serve as directors and reflectors, it is a but it only works in one band.

There are some proposals in the art which are actually related to this problem, the so called quasi-yagi antennas. Those antennas have one director, affecting the performance of the antenna; and they have either passive or active elements limiting the performance as well.

Current Single RAN (Radio Access Network) products are only Single Band. There is a big challenge to implement the wideband solution with current passive antennas.

Each one of the antenna elements is fed with an Adaptive Antenna Systems (AAS) element, where the antenna element can be the deep antenna solution or the traditional antenna solutions; the main challenge for the current Wideband Single RAN (Radio Access Network) solutions is the duplexer, which allows a transmitter operating on one frequency and a receiver operating on a different frequency to share one common antenna with a minimum of interaction and degradation of the different RF signals.

Radio receivers can be damaged if high level RF signals, like those directly from a transmitter output, is applied to the receiver antenna. Additionally, receivers may become 'desensitized' (or 'de-sensed') and not receive weak signals when high noise levels or another signal near the receive frequency is present at the receivers antenna input.

Obviously, radio receivers and transmitters cannot be directly connected to the same antenna without some device being used to:

Switch the antenna between the transmitter and receiver so that they are never connected to the same antenna at the same time.

When the transmit and receive frequencies are different, filters may be used to reduce the transmit signal levels to an acceptable low level at the receivers antenna input. Naturally, you cannot filter out the transmitter signal when it is the same as the receiver frequency.

As stated above, in Single band Adaptive Antenna Systems (AAS) with current antennas there is one Tx (transmission) band and one Rx (reception) band.

SUMMARY OF THE INVENTION

In accordance with the present invention there is provided an antenna arrangement comprising:

One driven element connected to a transmission line.

One reflector element, arranged in a preceding position to that of the driven element working at a working frequency of the antenna.

At least one director element, arranged in a following position in respect to that of the driven, adapted to work at different frequencies, wherein one of the at least one director elements is adapted to act as active element exciting the driven element when the reflector works at a working frequency of said at least one director element.

This antenna arrangement ensures a good directivity working in different bands and avoiding the need for either bulky antennas, or antenna sites having several antennas since as it won't be necessary to place an antenna for each mobile frequency, band or technology. The antenna arrangement will thus avoid the implementation of large size antennas in the sites. The latter is also to the environmental impact of the antenna hereby described, since the multiband antenna object of the invention may substitute several antennas working in different bands in mobile frequencies.

In addition, there is an improvement in the gain due the multiband antenna architecture; therefore the signal strength will be higher than that achieved by known antennas, improving the existing coverage, especially qhen working at low bands. The multiband antenna object of the invention, opposite to those disclosed in the previous art has more than one director elements; as the skilled in the art would appreciate having more directors means having more gain.

In conventional antenna arrangements, the antenna elements are either passive or active and this feature is fixed and immutable. By contrast, in the proposed antenna arrangement the director elements behave both as active and as passive elements depending on the working frequency (i.e. when working at 900 MHz, the 900 MHz dipole will behave as a director (active element) but when the working frequency is shifted to 1800 MHz then the 900 MHz dipole will behave as a passive element). Having passive elements improves the gain, whereas having active elements allows optimizing the gain for each band independently.

Moreover the antenna arrangement hereby described has a configuration defined by one or more arrays, thus having more diversity in the RX; the multiband antenna of the invention might have a 2D array configuration although a 3D array with orthogonal elements is preferred since it provides more diversity in the RX As previously stated the antenna arrangement hereby described works in different frequencies, hence the reflector, driven and directors length and spacing will be calculated depending of the work frequency of each dipole.

The spacing is chosen depending of which spacing frequency gives better gain. In a preferred embodiment of the invention the antenna arrangement has a fixed value for the distance between each element; said distance is hereby presented as a function of the wavelength and the working frequency F:

$$\text{Reflector-Driven} = 0.125 \times \text{wavelength} = \frac{37.5}{F}$$

$$\text{Driven-first Director} = 0.125 \times \text{wavelength} = \frac{37.5}{F}$$

$$\text{First Director} - \text{second Director} = 0.250 \times \text{wavelength} = \frac{75}{F}$$

$$\text{Second Director} - \text{third director} = 0.250 \times \text{wavelength} = \frac{75}{F}$$

Following directors are separated $$\text{by a distance set } 0.250 \times \text{wavelength} = \frac{75}{F}.$$

Same happens to the relations between working frequency and length of each elements of the antenna arrangement:

$$\text{Reflector} = 0.495 \times \text{wavelength} = \frac{148.5}{F}.$$

$$\text{Driven} = 0.473 \times \text{wavelength} = \frac{141.9}{F}.$$

$$\text{First Director} = 0.440 \times \text{wavelength} = \frac{132}{F}.$$

$$\text{Second Director } D2 = 0.435 \times \text{wavelength} = \frac{130.5}{F}.$$

$$\text{Third Director } D3 = 0.430 \times \text{wavelength} = \frac{129}{F}.$$

Successive directors have a reduction factor of 0.005 or $$\frac{1.5}{F}$$

(when taking the frequency as a reference value) shorter over the previous, eg. a fourth director would have a length of 0.425×wavelength—

$$\frac{127.5}{F}$$

when applying the frequency as reference value, except for the last director which would have a reduction factor of 0.007 or $$\frac{2.1}{F}$$

taking the second last director as a reference.

As the skilled in the art would appreciate, values set above are representative of a certain embodiment; therefore the length of each member is set in range of valid values set as follows.

So, starting from one side of the antenna we find the reflector which is separated from the next element of the antenna, the driven, which is arranged at a distance comprised between $$\frac{37.5}{F} \text{ and } \frac{45}{F}$$

meters from the reflector (being F is the working frequency of the antenna); following the driven we find the first director arranged at a distance set between $$\frac{37.5}{F} \text{ and } \frac{45}{F}$$

meters (being F is the working frequency of the antenna). Since the antenna may have more than one director we may find a second director arranged next to the first director (in the opposite direction to that of the reflector) at a distance set between $$\frac{45}{F} \text{ and } \frac{75}{F}$$

meters (being F is the working frequency). This feature may be replicated so we may find a third director arranged following the second director at a distance set between $$\frac{60}{F} \text{ and } \frac{75}{F}$$

meters (being F is the working frequency); the multiband antenna may comprises as many directors as needed, successive directors should follow the rule described above, this means to apply a reduction factor set between $$\frac{1.5}{F} \text{ and } \frac{10}{F}.$$

DETAILED DESCRIPTION OF A PREFERRED EMBODIMENT

Figure 1:
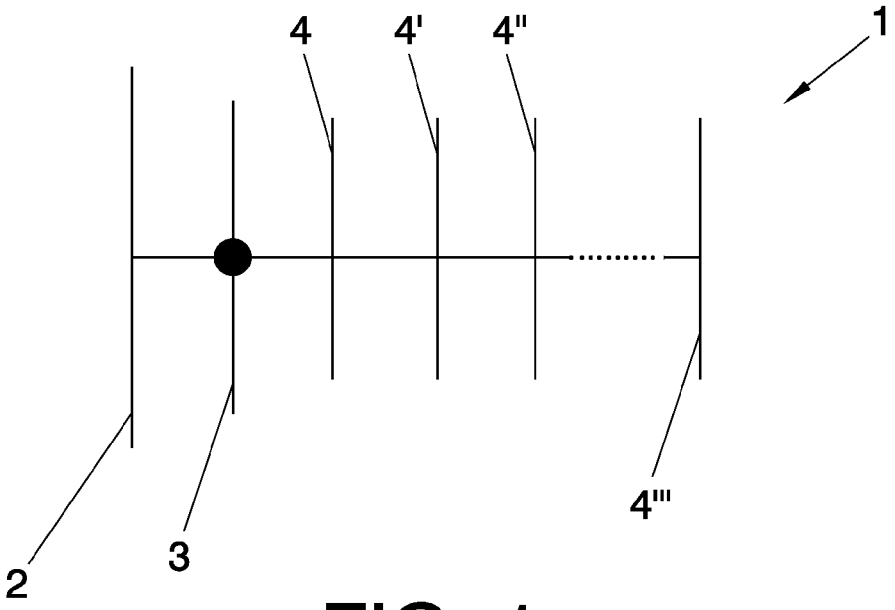
FIG. 1. Depicts a flat view of the antenna of the invention.

In the light of the abovementioned figures and following the adopted numbering, in FIG. 1 we can see the outline of the implementation of the antenna (1) arrangement object of the invention depicted in FIG. 1.

Figure 2:
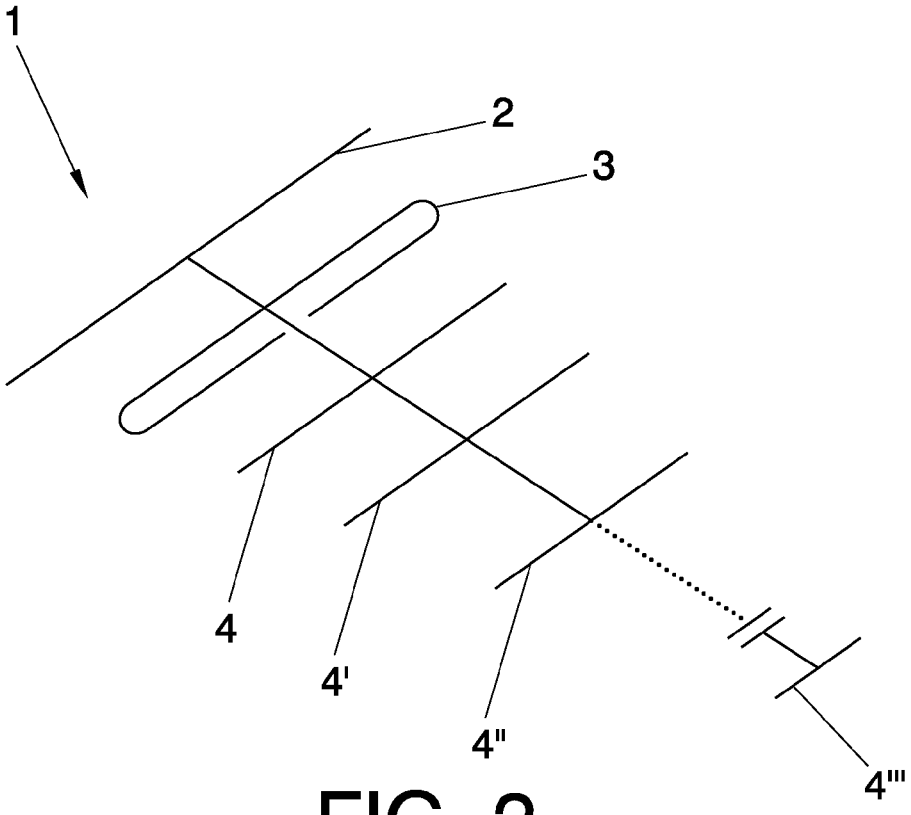
FIG. 2. Depicts an isometric representation of the antenna of the invention.

In a preferred embodiment of the object of the present invention the antenna (1) arrangement has a reflector element (2) working in working frequency F set at 900 MHz, with the reflector element (2), a driven element (3) and several director elements (4,4',4",4''') being arranged in parallel and comprised in the same plane. As shown in FIG. 2 the reflector element (2) is separated from the driven element (3), the driven element (3) from the director elements (4,4',4",4'''), all of them are separated by a distance which is frequency F dependent, being F the working frequency.

The antenna (1) arrangement detailed in this preferred embodiment works in different bands, namely: 900 Mhz, 1800 Mhz, 2100 MHz and 2600 MHz; in this preferred embodiment the reflector element (2) works in 900 MHz, thus taking into account the relationship between working frequency F and length the sizes of the elements yield a relationship as follows:

Reflector element (2) length=(150/900) meters.

Driven element (3) length=143/900 meters.

First director element (4) length=138/1800 meters.

Second director element (4') length=134/2100 meters.

Third director element (4") length=129/2600 meters.

Additional director element (4''') length depends on any further working frequency.

In this preferred embodiment the above mentioned elements are arranged forming a flat multiband antenna (1) with all of the reflector element (2), the driven element (3) and the director elements (4,4',4",4''') are comprised in the same plane and prearranged as follows.

The reflector element (2) is allocated at the very end of the multiband antenna (1) and is separated from the next element of the antenna (1), the driven element (3), by a distance comprised between $$\frac{37.5}{F} \text{ and } \frac{45}{F}$$

meters (being F is the working frequency of the antenna); following the driven element (3) we find the first director element (4) arranged at a distance set between $$\frac{37.5}{F} \text{ and } \frac{45}{F}$$

meters (being F is the working frequency of the antenna) from the driven (3). Since in this embodiment the multiband antenna (1) works in several frequencies, the antenna (1) has more than one director element (4,4',4",4'''); consequently the second director element (4') is arranged next to the first director element (4) (in the opposite direction to that of the driven element (3)) at a distance set between $$\frac{45}{F} \text{ and } \frac{75}{F}$$

meters (being F is the working frequency). The remaining working frequency is handled by the third director element (4") which is set at a distance set between $$\frac{60}{F} \text{ and } \frac{75}{F}$$

meters (being F is the working frequency) from the second director element (4"). If needed, any additional director element (4''') is mounted separated from the third director element (4") at a distance of at least $$\frac{75}{F}$$

meters.

Another embodiment of the antenna (1) arrangement of the invention provides a solution for Adaptive Antenna Systems (AAS) using duplexers; wherein the transmission is done through a broadband dipole and the reception is splitted between different dipoles: each band through a different dipole.

In this embodiment we have the following transmission and reception frequencies:

TX: 2100 MHz

RX: is 1920~1980 MHz

As earlier stated Wideband Adaptive Antenna Systems (AAS) with current antennas would have two transmission Tx bands and two reception Rx bands.

TX1: 1800 MHz

TX2: 2100 MHz

RX1: 1710-1785 MHz

RX2 (RX band of TX2) is 1920~1980 MHz

The duplexer is a 4-band filter as can be seen in FIG. 1*c*)

RX2 is in the middle of the TX1 and TX2

As a filter of RX2 has to reject the Tx signal from 2 TX (TX1 band and TX2 band), the difficulty is the double comparing to DUP of Single Band system. It is the same for TX1, a 1805~1880 MHz filter.

By implementing the antenna (1) arrangement object of the invention we have:

Dipol f1-f2:

TX1: 1800 MHz

TX2: 2100 MHz

RX1: 1710-1785 MHz

Dipol f2:

RX2 (rx band of TX2) is 1920~1980 MHz

Figure 3:
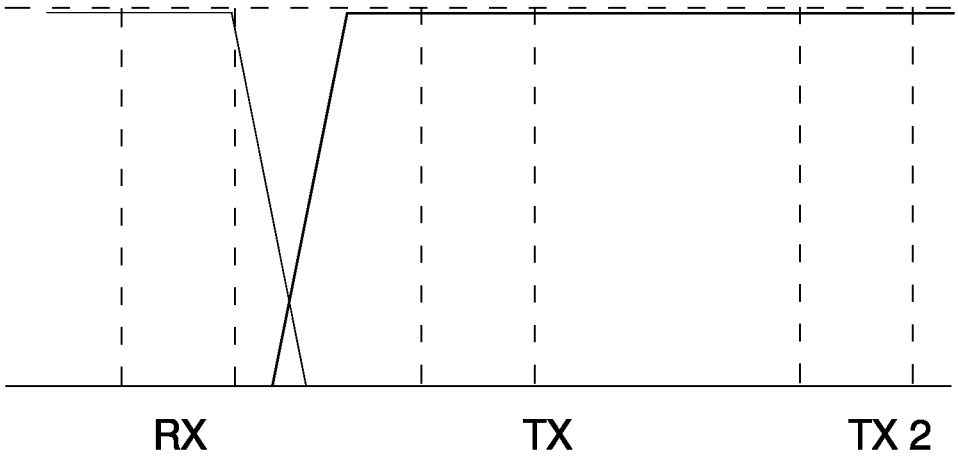
FIG. 3. Depicts a duplexer configuration used with the antenna arrangement of the invention.
Figure 4:
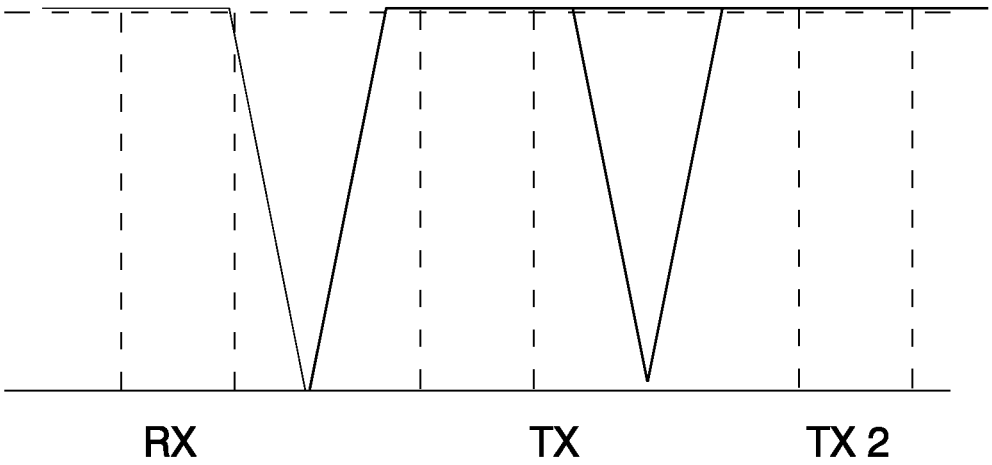
FIG. 4. Depicts an optional duplexer configuration used with the antenna arrangement of the invention.

The RX2 band located in between the two TX bands is not received by dipol f1-f2 so duplexer is simplified as seen in FIGS. 3 and 4.

The same concept applied to Adaptive Antenna Systems (AAS) could be applied for any other radio unit.

The invention claimed is:

1. Antenna arrangement comprising:

one driven element connected to a transmission line, one reflector element, arranged in a preceding position to that of the driven element, working at a working frequency F of the antenna at least one director element arranged in a following position in respect to that of the driven element, adapted to work at different frequencies, wherein only one of said at least one director element is adapted to act as active element exciting the driven element when the reflector element works at a working frequency F of said at least one director element.

2. Antenna arrangement according to claim 1 wherein the reflector element and the driven element are separated by a distance comprised in a range set between $$\frac{37.5}{F} \text{ and } \frac{45}{F}$$

meters wherein F is the working frequency.

3. Antenna (1) arrangement according to claim 1 wherein said at least one director element is a first director element that is arranged closer to the driven element.

4. Antenna arrangement according to claim 3 wherein the driven element and a first director element are separated by a distance comprised in a range set between $$\frac{37.5}{F} \text{ and } \frac{45}{F}$$

meters wherein F is the working frequency.

5. Antenna arrangement according to claim 3 further including a second director element which is arranged following the first director element.

6. Antenna arrangement according to claim 5 wherein the second director element is separated from the first director element by a distance in a range between $$\frac{45}{F} \text{ and } \frac{75}{F}$$

meters wherein F is the working frequency.

7. Antenna arrangement according to claim 5 further including a third director element which is arranged following the second director element.

8. Antenna arrangement according to claim 7 wherein the third director element is separated from the second director element by a distance comprised in a range set between $$\frac{60}{F} \text{ and } \frac{75}{F}$$

meters wherein F is the working frequency.

9. Antenna arrangement according to claim 3 wherein the length of the first director element is in a range between $$\frac{138}{F} \text{ and } \frac{150}{F}$$

meters wherein F is the working frequency.

10. Antenna arrangement according to claim 1, further including at least one additional director element following the third director element.

11. Antenna arrangement according to claim 10 wherein any one of the at least one additional director elements is separated from any other director elements arranged in a preceding position by a distance set in $$\frac{75}{F}$$

meters wherein F is the working frequency.

12. Antenna arrangement according to claim 1 wherein the length of the reflector element is in a range between $$\frac{148.5}{F} \text{ and } \frac{150}{F}$$

meters wherein F is the working frequency.

13. Antenna arrangement according to claim 1 wherein the length of the driven element is comprised in a range between $$\frac{141.9}{F} \text{ and } \frac{143}{F}$$

meters wherein F is the working frequency.

14. Antenna arrangement according to claim 1 wherein the driven element; the reflector element and the at least one director element are coplanar.

15. Antenna arrangement according to claim 1 wherein the driven element the reflector element and the at least one director element define a tri-dimensional structure.

* * * * *